US009482424B2

(12) United States Patent
Boonekamp et al.

(10) Patent No.: US 9,482,424 B2
(45) Date of Patent: Nov. 1, 2016

(54) LIGHTING DEVICE HAVING A REMOTE WAVELENGTH CONVERTING LAYER

(71) Applicant: KONINKLIJKE PHILIPS N.V., Eindhoven (NL)

(72) Inventors: Erik Paul Boonekamp, Utrecht (NL); Shufen Tsoi, Weert (NL); Andreas Aloysius Henricus Duijmelink, Aarle-Rixtel (NL); Gerardus Wilhelmus Gerbe Van Dreumel, Nijmegen (NL)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 154 days.

(21) Appl. No.: 14/405,185

(22) PCT Filed: May 28, 2013

(86) PCT No.: PCT/IB2013/054388

§ 371 (c)(1),
(2) Date: Dec. 3, 2014

(87) PCT Pub. No.: WO2013/182950

PCT Pub. Date: Dec. 12, 2013

(65) Prior Publication Data

US 2015/0146407 A1 May 28, 2015

Related U.S. Application Data

(60) Provisional application No. 61/655,538, filed on Jun. 5, 2012.

(51) Int. Cl.
*F21K 9/64* (2016.01)
*F21V 29/70* (2015.01)

(Continued)

(52) U.S. Cl.
CPC ..... *F21V 29/70* (2015.01); *F21K 9/56* (2013.01); *F21S 4/28* (2016.01); *F21V 3/02* (2013.01);

(Continued)

(58) Field of Classification Search
CPC ..... F21K 9/56
USPC ..... 313/502
See application file for complete search history.

(56) References Cited

U.S. PATENT DOCUMENTS

2008/0029720 A1 2/2008 Li
2008/0186737 A1* 8/2008 Awai ..... G02B 6/002 362/617

(Continued)

FOREIGN PATENT DOCUMENTS

CN 101696790 A 4/2010
CN 201606695 U 10/2010

(Continued)

*Primary Examiner* — Anne Hines
*Assistant Examiner* — Christopher Raabe

(57) ABSTRACT

According to an aspect of the present invention, a lighting device (2) is provided. The lighting device (2) comprises a wavelength converting layer (21) having a curved shape and a light source (22) arranged to emit light towards the wavelength converting layer (21). The wavelength converting layer (21) intersects a plane extending through the light source (22) and being parallel with the optical axis of the light source (22), at a curve given, in a polar coordinate system centered at the light source (22), by the equation: $R(\phi)=k\cdot I(\phi)^{1/2}\pm D$, wherein k is a constant, 0 is an angle with respect to said optical axis, /(ϕ) is a function defining a luminous intensity profile of the light source and D is a deviation ranging from zero to 20% of the maximum value of said curve, $R_{max}$. The present invention is advantageous in that the lighting device (2) has a more uniform color distribution of emitted light across the wavelength converting layer (21) and the risk of color gradients and artifacts is reduced.

11 Claims, 3 Drawing Sheets

(51) Int. Cl.

| | |
|---|---|
| ***F21V 3/02*** | (2006.01) |
| ***F21V 9/16*** | (2006.01) |
| ***F21K 99/00*** | (2016.01) |
| *F21V 3/04* | (2006.01) |
| *F21V 29/00* | (2015.01) |
| *F21V 13/02* | (2006.01) |
| *F21Y 101/02* | (2006.01) |
| *F21Y 103/00* | (2016.01) |

(52) U.S. Cl.
CPC .. *F21V 9/16* (2013.01); *F21V 3/04* (2013.01); *F21V 3/0463* (2013.01); *F21V 3/0472* (2013.01); *F21V 13/02* (2013.01); *F21V 29/20* (2013.01); *F21Y 2101/02* (2013.01); *F21Y 2103/003* (2013.01)

(56) References Cited

U.S. PATENT DOCUMENTS

| | | | |
|---|---|---|---|
| 2010/0220476 | A1 | 9/2010 | Kuo et al. |
| 2011/0140593 | A1 | 6/2011 | Negley et al. |
| 2011/0215696 | A1 | 9/2011 | Tong et al. |
| 2011/0286200 | A1 | 11/2011 | Iimura et al. |
| 2011/0292644 | A1 | 12/2011 | Cohen |

FOREIGN PATENT DOCUMENTS

| | | | |
|---|---|---|---|
| EP | 2293355 | A2 | 3/2011 |
| EP | 2555261 | A1 | 2/2013 |
| WO | 2010143093 | A1 | 12/2010 |
| WO | 2011146677 | A2 | 11/2011 |
| WO | 2012009921 | A1 | 1/2012 |

* cited by examiner

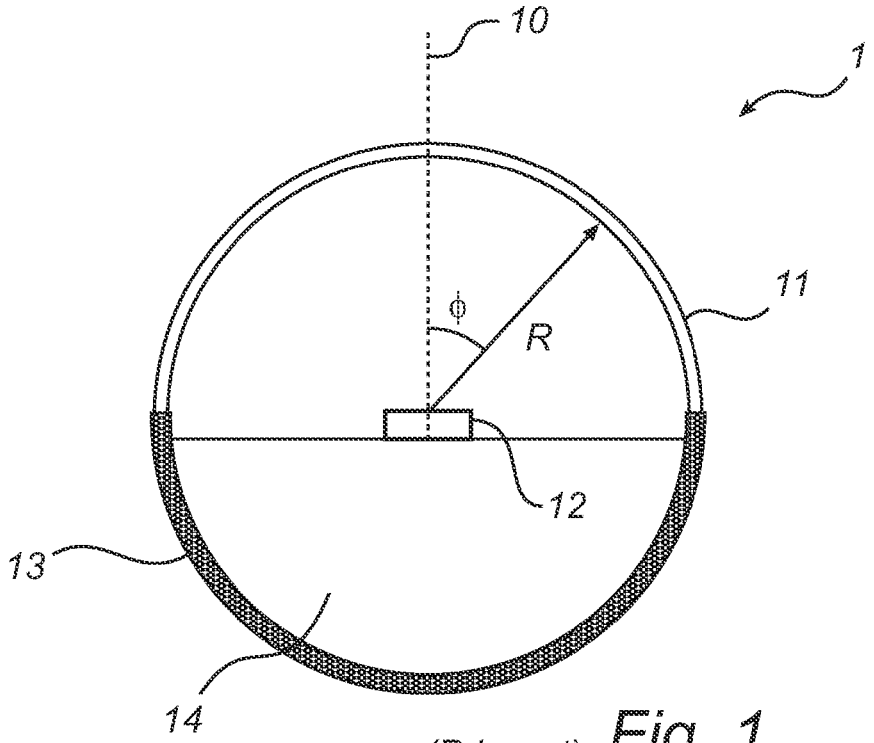
(Prior art) Fig. 1
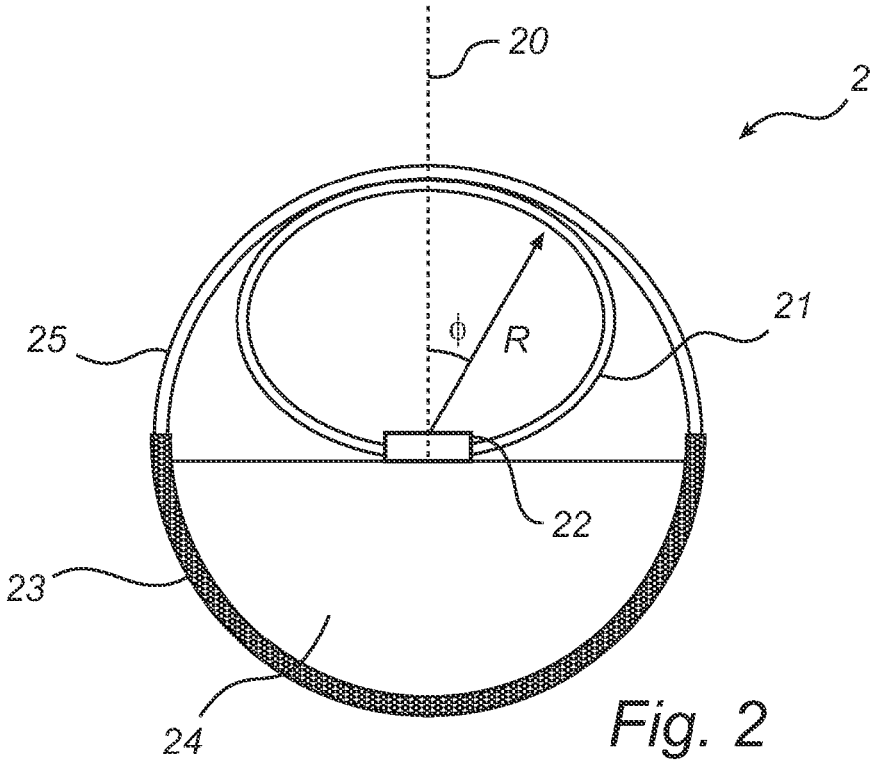
Fig. 2

LIGHTING DEVICE HAVING A REMOTE WAVELENGTH CONVERTING LAYER

CROSS-REFERENCE TO PRIOR APPLICATIONS

This application is the U.S. National Phase application under 35 U.S.C. §371 of International Application No. PCT/IB13/054388, filed on May 28, 2013, which claims the benefit of U.S. Provisional Patent Application No. 61/655,538, filed on Jun. 5, 2012. These applications are hereby incorporated by reference herein.

FIELD OF THE INVENTION

The present invention generally relates to the field of lighting devices having remote wavelength converting layers.

BACKGROUND OF THE INVENTION

Wavelength converting materials, such as phosphors, are used for tuning the color of light emitting diode (LED) based light sources. Phosphors in combination with blue LEDs are used to produce white light. Depending on the type of phosphors and the amount of conversion, the color can be tuned to achieve a desired color such as cool white or warm white. The white light is produced by a combination of transmitted (unconverted) blue light and converted, often yellowish, light.

When the phosphor is arranged in a substrate or layer separate, i.e. at a certain distance, from the LED, it is referred to as a remote phosphor layer. Such a remote phosphor layer may be provided directly in an outer envelope of the lighting device or as a separate layer inside the envelope. Examples of such lighting devices are shown in CN201606695 and EP2293355.

A problem with remote phosphor layers is that the color distribution of light emitted from the exit surface, i.e. the surface of the remote phosphor layer from which light is emitted, may be non-uniform. This is in particular the case in LED-based tube lamps having e.g. blue LEDs and a phosphor mixture in the curved envelope, wherein yellow lines are visible at the edges of the envelope at angles close to ±90° with respect to an optical axis of the lamp.

SUMMARY OF THE INVENTION

It is an object of the present invention to overcome this problem and to provide a lighting device with a more uniform color distribution of emitted light across the wavelength converting layer.

According to an aspect of the present invention, this and other objects are achieved by a lighting device as defined in the independent claim. Embodiments of the invention are defined in the dependent claims.

According to an aspect of the present invention, a lighting device is provided. The lighting device comprises a wavelength converting layer having a curved shape and a light source arranged to emit light towards the wavelength converting layer. The wavelength converting layer intersects a plane extending through the light source and being parallel with the optical axis of the light source, at a curve given, in a polar coordinate system centered at the light source, by the equation:

$$R(\phi)=k\cdot I(\phi)^{1/2}\pm D \qquad \text{(Equation 1)}$$

wherein k is a constant, $\phi$ is an angle with respect to the optical axis, $I(\phi)$ is a function defining a luminous intensity profile of the light source and D is a deviation ranging from zero to 20% of the maximum value of said curve, $R_{max}$.

Another way of defining the wavelength converting layer is that the outline of the shape of the wavelength converting layer is defined by a curve whose radius R is, in a polar coordinate system centered at the light source, expressed by Equation 1, wherein k is a constant, $\phi$ is an angle with respect to the optical axis, $I(\phi)$ is a function defining a light intensity profile of the light source and D is a deviation ranging from zero to 20% of the maximum value of said curve, $R_{max}$.

The inventors have realized that the non-uniform color distribution obtained in prior art lighting devices is caused by the non-uniform illumination of the wavelength converting layer by the light source. Light sources such as LEDs often have a Lambertian-like light distribution pattern, which means that the light intensity is higher in the main forward emission direction, which is right above or in front of the light source, i.e. at a point opposite to a base at which the light source is mounted, than in the lateral directions. When using a conventional semi-circle-shaped wavelength converting layer as typically used in linear lighting devices, the less illuminated edges or near edge regions of the wavelength converting layer have a slightly different color compared to the more illuminated regions, which correspond to the mid, or upper relative to a lower base at which the light source may be arranged, portion of the wavelength converting layer. The less illuminated edges have a color closer to the color of the wavelength converting material while the more illuminated regions have a color more towards the color of the LEDs. For example, if one or more blue LEDs and a yellow phosphor are used, the edges of the wavelength converting layer will appear to be closer to yellow than the upper portion of the curved wavelength converting layer, which will be appear to be closer to blue.

The illuminance E of the wavelength converting layer depends on the distance Rbetween the light source and the wavelength converting layer and the luminous intensity profile $I(\phi)$ of the light source, which profile depends on the angle $\phi$ of a light path with respect to the optical axis of the light source, according to the equation:

$$E(\phi)=\frac{I(\phi)}{R^2} \qquad \text{(Equation 2)}$$

If instead the illuminance E is held constant and the distance R is allowed to vary as a function of the angle, an equation is obtained defining a curve shape of the wavelength converting layer, which will be more uniformly illuminated compared to a conventional wavelength converting layer not adapted to the luminous intensity distribution profile of the light source. The distance may thus be defined as:

$$R(\phi)=\left(\frac{I(\phi)}{E}\right)^{1/2} \qquad \text{(Equation 3)}$$

Equation 3 defines a curve on which the shape of the wavelength converting layer preferably may be based in order to obtain a more uniform illuminance, and thereby a more uniform, or more out leveled, color gradient at the wavelength converting layer.

The present invention uses the concept of adapting the curve shape of the wavelength converting layer to the luminous intensity distribution of the light source such that the distance from the light source to the wavelength converting layer is shorter at angles $\phi$ where the luminous intensity is lower and longer at angles $\phi$ where the luminous intensity is higher. A curve shape of the wavelength converting layer as defined by Equation 1 is adapted to the luminous intensity distribution pattern of the light source, whereby the wavelength converting layer is more uniformly illuminated.

The present invention is thus advantageous in that the lighting device provides a more uniform color distribution of emitted light across the wavelength converting layer and the risk for color gradients and artifacts is reduced. In addition, the far field luminous intensity of the lighting device is more uniform due to the more uniformly illuminated wavelength converting layer.

A deviation, as defined by ±D in Equation 1, from the luminous intensity profile based curve shape, $k \cdot I(\phi)^{1/2}$, may be envisaged while still providing a more uniform illuminance of the wavelength converting layer compared to prior art. It will be appreciated that the deviation D ranging from zero to 20% of the maximum value of the curve $R_{max}$ may be constant or vary with the angle $\phi$. Preferably, the deviation D may range from zero to 10%, even more preferably to 5%, of the maximum value of the curve $R_{max}$. Alternatively, the deviation D may range from zero to 20% of $R(\phi)$.

It will be appreciated that the plane, which the wavelength converting layer intersects, is an imaginary, i.e. fictitious, plane extending through the light source and being substantially parallel with the optical axis of the light source. Further, in the present disclosure the optical axis may be an axis extending through the light source and being parallel with the main forward emission direction of the light source which typically, in particular for LEDs, is the direction at which the emitted light intensity is highest.

According to an embodiment, the wavelength converting layer may intersect the plane with a curve given in a polar coordinate system centered at the light source by the equation:

$$R(\phi)=k\cdot\cos(\phi)^{1/2}\pm D \quad \text{(Equation 4)}$$

In case of a Lambertian-type light source the luminous intensity profile can be defined as:

$$I(\phi)=I_0\cdot\cos(\phi) \quad \text{(Equation 5)}$$

wherein $I_0$ is the luminous intensity of the light source at $\phi=0$. Incorporating Equation 5 into Equation 2 shows that the maximum illuminance $E_{max}$ of a conventional semi-circle-shaped wavelength converting layer is located opposite to or in front of the light source, close to $\phi=0$, while the illuminance at the edges, close to $\phi=\pm 90°$, is negligible and virtually zero. With the present embodiment, the curve shape of the wavelength converting layer is adapted to the luminous intensity distribution profile of a Lambertian-type light source. Incorporating Equation 5 into Equation 3 gives a definition of a distance according to Equation 6:

$$R(\phi)=\left(\frac{I_0}{E}\right)^{1/2}\cdot(\cos(\phi))^{1/2} \quad \text{(Equation 6)}$$

Equation 6 defines a cosine based curve on which the shape of the wavelength converting layer preferably may be based for use in combination with Lambertian-type light sources in order to obtain a more uniform illuminance, and thereby a more uniform, i.e. more out leveled, color gradient at the wavelength converting layer. The term $(I_0/E)^{1/2}$ can be expressed as a constant k, whereby Equation 4 is provided for defining a preferable curve shape of the wavelength converting layer.

According to an embodiment of the present invention, the wavelength converting layer may intersect the curve as defined by Equation 1 or Equation 4 at least from $\phi=-30°$ to $\phi=30°$, preferably at least from $\phi=-60°$ to $\phi=60°$, and even more preferably at least from $\phi=75°$ to $\phi=75°$. Hence, a considerable, and preferably a major, part of the wavelength converting layer follows the curve given by Equation 1 or Equation 4, and the wavelength converting layer is therefore more uniformly illuminated as compared to prior art wavelength converting layers.

According to an embodiment of the present invention, the wavelength converting layer may intersect the curve at most from $\phi=80°$ to $\phi=80°$. The present embodiment is advantageous in that the closest distance from the wavelength converting layer to the light source is increased, whereby a higher chemical stability of the wavelength converting material is obtained. Hence, the wavelength converting layer may not extend all the way to the light source, leaving a space between the light source and the edges of wavelength converting layer. This is advantageous since wavelength converting material located in the very proximity of a light source tends to gradually deteriorate due to the heat generated by the light source and high energy light from the light source.

In an embodiment, the constant k may have a value comprised within the interval 0.005 to 0.02 meter, which results in an appropriate shape of the wavelength converting layer, defined in meter, when using an LED having a luminous intensity of around 5 lm to 200 lm at $\phi=0$ as a light source. Preferably, the constant k may be higher when using a light source with higher luminous intensity and lower when using a light source with lower light intensity. For example, the value of the constant k may be determined based on the desired illuminance E and the luminous intensity $I_0$ of the light source at $\phi=0$ according to the following equation:

$$k=\left(\frac{I_0}{E}\right)^{1/2} \quad \text{(Equation 7)}$$

As an example, when using T8 LEDs having a luminous intensity of around 50 lm/LED, the constant k may be preferably around 0.0127 meter.

According to an embodiment of the present invention, the light source may be configured to emit light with a Lambertian-like distribution, which implies a higher light intensity in the forward emission direction than in the lateral directions. The light source may e.g. be a Lambertian-type light source. The present embodiment is advantageous in that the shape of the wavelength converting layer and the light distribution of the light source are better adapted to each other, i.e. match each other, whereby the illuminance of the wavelength converting layer becomes even more uniform. For example, the light source may be a solid state light source, such as an LED, which typically provides a Lambertian-like light intensity distribution pattern.

According to an embodiment, the wavelength converting layer may comprise diffusing means whereby light from the light source is scattered into a wider intensity distribution by the wavelength converting layer. The diffusing means may be scattering particles, a scattering surface structure, e.g. a rough surface, and/or air voids in the wavelength converting layer. Alternatively, or as a complement, a separate diffusing layer may be arranged outside the wavelength converting layer, i.e. on the side of the wavelength converting layer not facing the light source. Such diffusing layer may e.g. be a holographically made diffuser surface or simply an optical layer comprising scattering particles or a scattering surface structure. In the present embodiments, the diffusing means may be anisotropic, which is advantageous for linear light sources, wherein the diffusing means may be adapted to scatter light in the length direction of the tube.

For shaping the light distribution, the lighting device may comprise optical structures, such as prisms, preferably arranged outside the wavelength converting layer. Such optical structures may be adapted to refracting light in any desired directions.

According to an embodiment of the present invention, the lighting device may further comprise an envelope enclosing the light source and the wavelength converting layer, whereby the wavelength converting layer is better protected from damage. The envelope may have any desired shape and may not necessarily follow the curve shape of the wavelength converting layer. Hence, the envelope may have e.g. a conventional semi-circular shape in case of a linear-type lighting device, whereby the lighting device will have the appearance of a conventional lighting device. Optionally, the envelope may comprise diffusing means as those described in the preceding embodiment.

According to an embodiment of the present invention, a gap, such as an air gap, is defined between the wavelength converting layer and the envelope, whereby the wavelength converting layer and the envelope may be physically separated for disabling optical contact there between. Hence, the outer surface of the wavelength converting layer and the inner surface of the envelope may be physically separated for providing an air gap or a gap with any gas or vacuum. Alternatively, or as a complement, the surface of the wavelength converting layer facing the envelope may have an uneven surface structure, such as being rough, thereby reducing the optical contact between the wavelength converting layer and the envelope even if they about each other. In the present disclosure, the term "optical contact" means the physical contact between two optical bodies having similar refractive indices implying just a slight, i.e. negligible, or no refraction of light traveling across the boundary between the two optical bodies. The optical contact between the wavelength converting layer and the envelope may preferably be reduced, or even avoided, as it may influence the light distribution in terms of both intensity and color.

According to an embodiment, the lighting device may be a linear-type lighting device. The lighting device may hence have an elongated shape and the light sources may be arranged in a row. Looking into a cross section of such a linear-type lighting device, taken along a plane perpendicular to the longitudinal direction of the lighting device, the light source is similar to a point-like light source, whereby the illuminance across the wavelength converting layer in the direction perpendicular to the longitudinal direction of the lighting device is more uniform. Further, the wavelength converting layer may be elongated and the plane, which the wavelength converting layer intersects, may be perpendicular to the longitudinal direction of the wavelength converting layer, thereby making illuminance of the wavelength converting layer even more uniform. It will be appreciated that the linear-type lighting device may have any desired shape as long as the light sources are arranged in a row, such as elongated and curved, or torus shaped.

BRIEF DESCRIPTION OF THE DRAWINGS

This and other aspects of the present invention will now be described in more detail, with reference to the appended drawings showing embodiments of the invention.

FIG. 1 is a cross sectional view of a lighting device according to prior art.

FIG. 2 is a cross sectional view of a lighting device according to an embodiment of the present invention.

Figure 3:
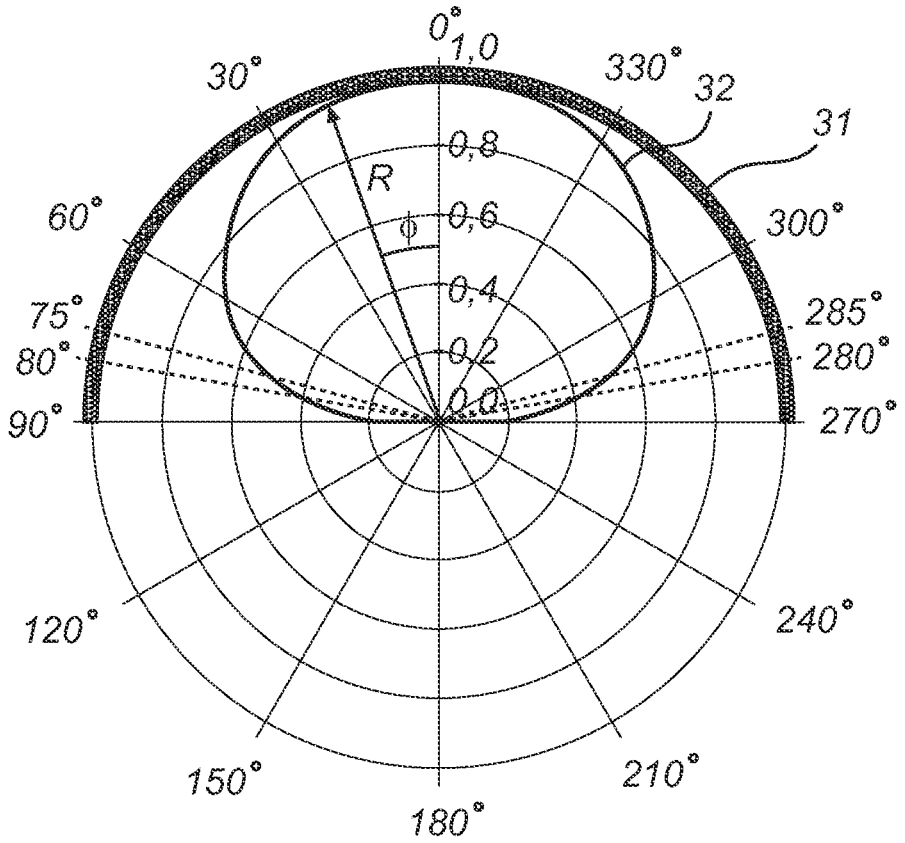
FIG. 3 shows a polar coordinate system in which a curve shape according to an embodiment of the present invention is represented.

All the figures are schematic, not necessarily to scale, and generally only show parts which are necessary in order to elucidate the invention, wherein other parts may be omitted or merely suggested.

DETAILED DESCRIPTION

With reference to FIG. 1, a lighting device according to prior art will be described. FIG. 1 is a cross sectional view taken along a plane perpendicular to the longitudinal direction of a linear-type lighting device 1. The lighting device 1 comprises a blue LED 12, i.e. an LED emitting blue light, a heat sink 13 with a cavity 14 for driving electronics (not shown) and a wavelength converting layer 11, which also functions as an envelope enclosing the LED 12. The wavelength converting layer 11 comprises wavelength converting material, such as yellow phosphor, i.e. a phosphor emitting yellow light upon absorption of photons, preferably from the blue light of the LED 12, for providing a certain color of the light output from the lighting device 1. The distance from the LED 12 to the wavelength converting layer 11 is denoted R and the angle with respect to the optical axis 10 of the LED 12 is denoted $\phi$. The cross section of the wavelength converting layer 11 is semi-circular and the distance R is the same irrespective of the angle $\phi$ and, hence, constant across the wavelength converting layer 11. As LEDs typically have a Lambertian-type light intensity distribution, the wavelength converting layer 11 will be non-uniformly illuminated when the LED 12 is turned on, whereby a color gradient across the envelope will be visible. Typically, the portion of the wavelength converting layer opposite to or in front of the LED 12 will be more blue than the near edge portions, which will be more yellow, due to the higher light intensity of the LED 12 in the forward direction than in the lateral directions.

With reference to FIG. 2, a lighting device according to an embodiment of the present invention will be described. FIG. 2 is a cross sectional view taken along a plane perpendicular to the longitudinal direction of a linear-type lighting device 2 such as a tube lamp. Light sources 22 are arranged in a row or line in the lighting device 2, preferably with a pitch, i.e. a distance between the light sources 22, sufficiently small to reduce visible spots at the surface of the envelope of the lighting device 2. As the cross sectional view in FIG. 2 is taken perpendicular to the longitudinal direction of the linear-type lighting device 2, only one light source 22 is visible in the figure.

The lighting device 2 further comprises a heat sink 23 defining a cavity 24 in which the electronics (not shown) for driving the light sources 22 are arranged, a wavelength converting layer 21 and an envelope 25 enclosing the wavelength converting layer 21 and the light sources 22. The wavelength converting layer 21 comprises wavelength converting material, or luminescent material, such as phosphor pigments (e.g. YAG:Ce) and/or luminescent dye for converting the wavelength of the light from the light sources 22 into a desired color.

The shape of the wavelength converting layer 21 is advantageously adapted to the luminous intensity distribution pattern of the light source so as to obtain a more uniform illuminance of the wavelength converting layer 21 than that obtained in the prior art device described with reference to FIG. 1. In the present embodiment, the wavelength converting layer 21 intersects a fictitious plane extending through the light source 22 and being parallel with the optical axis 20 of the light source 22, at a curve given, in a polar coordinate system centered at the light source 22, by the equation:

$$R(\phi)=k\cdot\cos(\phi)^{1/2}\pm D \qquad \text{(Equation 4)}$$

wherein k is a constant, $\phi$ is an angle with respect to the optical axis 20 and D is a deviation ranging from zero to 20% of the maximum value of the curve, $R_{max}$. The plane which the wavelength converting layer 21 intersects is, in the present example as shown in FIG. 2, perpendicular to the longitudinal direction of the linear lighting device 2 and thus parallel with the plane at which the cross section is taken in the figure. The constant k may be set to a value adapted for obtaining an appropriate size of the wavelength converting layer 22 and/or an appropriate distance from the light source 22 to the wavelength converting layer 21. For example, the value of the constant k may be based on the desired illuminance E at the wavelength converting layer 22 and the far-field luminous intensity $I_0$ of the light source 22 at $\phi=0$ according to the equation:

$$k=\left(\frac{I_0}{E}\right)^{1/2} \qquad \text{(Equation 7)}$$

FIG. 3 shows the curve 32 as defined by Equation 1 represented in a polar coordinate system. In the present non-limiting illustrative example, the constant is set to k=1 and the deviation is set to D=0. As can be seen in both FIG. 2 and FIG. 3, the maximum distance, represented by the maximum value of the curve $R_{max}$ from the light source 22, positioned at the pole of the polar coordinate system, to the wavelength converting layer 21 is in front of or above the light source 22 at $\phi=0$ where also the light intensity from the light source 22 is the highest, while the distance from the light source 22 to the wavelength converting layer 21 is at least near zero at $\phi=90°$ and $\phi=270°$ (also referred to as $\phi=-90°$ in the present disclosure), at which angles also the light intensity from the light source 22 is the lowest.

For comparison, a curve 31 representing the shape of the prior art wavelength converting layer, as described with reference to FIG. 1, is also represented in the polar coordinate system. As can be seen in both FIG. 3 and FIG. 1, the distance between the light source 12 and the wavelength converting layer 11 represented by curve 31 is constant from $\phi=90°$ to $\phi=270°$. The equal distance at low and high angles implies that the illuminance of the wavelength converting layer 11 will be relatively high at low angles, i.e. close to $\phi=0$, and relatively low at high angles, i.e. close to $\phi=90°$ and $\phi=270°$.

Figure 4:
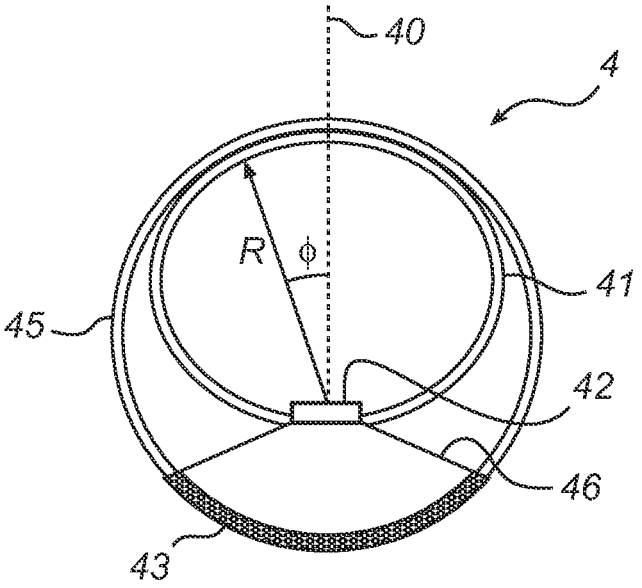
FIG. 4 is a cross sectional view of a lighting device according to another embodiment of the present invention.

With reference to FIG. 4, an embodiment of the present invention will be described. FIG. 4 shows a lighting device 4 similar to the lighting device 2 described with reference to FIG. 2, with the difference that the heat sink 43 is arranged such that it shadows less light from the light source 42, wherein the light source 42 is slightly elevated with respect to the heat sink 43. With the present embodiment, the lateral extension or width of heat sink 43 is reduced such that more light is emitted backwardly relative to the forward emission direction parallel with the optical axis 40 of the light source 42. Hence, a more omni-directional light distribution is obtained. Further, a base at which the light sources 42 are arranged is covered by a reflector 46, which may be diffuse or specular, for increasing the light output from the lighting device 4. The wavelength converting layer 41 may be configured as in the embodiment described with reference to FIG. 2. The envelope 45 is arranged to cover the wavelength converting layer 41 and the light source 42.

Figure 5:
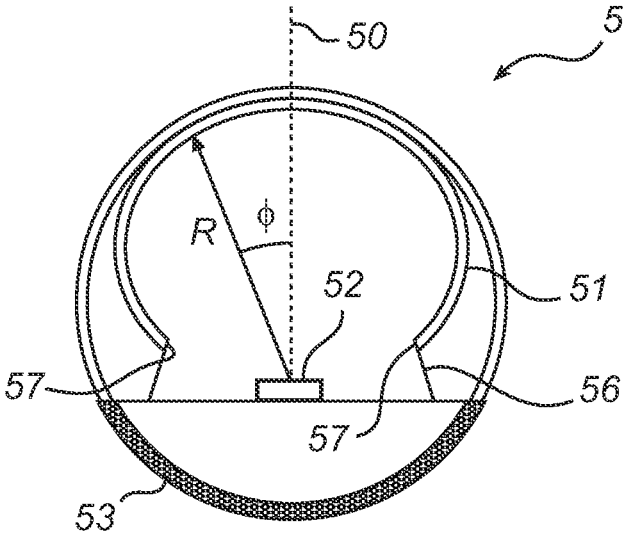
FIG. 5 is a cross sectional view of a lighting device according to yet another embodiment of the present invention.

With reference to FIG. 5, another embodiment of the present invention will be described. FIG. 5 shows a lighting device 5 similar to the lighting device 2 described with reference to FIG. 2, with the difference that the wavelength converting layer 51 intersects the curve defined by Equation 1 at a narrower angle interval. Preferably, the wavelength converting layer 51 may intersect the curve at least from $\phi=-30°$ (also referred to as $\phi=330°$) to $\phi=30°$, preferably from $\phi=-60°$ (also referred to as $\phi=300°$) to $\phi=60°$, and even more preferably at least from $\phi=-75°$ (also referred to as $\phi=285°$ to $\phi=75°$, with respect to the optical axis 50 of the light source 52. However, in the present embodiment, the wavelength converting layer 51 may intersect the curve at most from $\phi=-80°$ (also referred to as $\phi=280°$) to $\phi=80°$. The more limited coincidence with the curve provides a space between the light source 52 and the edges 57 of the wavelength converting layer 51, i.e. the edges or end points at which the curved shape as defined in accordance with Equation 1 terminates, and the closest distance from the wavelength converting layer 51 to the light source 52 is increased compared to the embodiment described with reference to e.g. FIG. 2. As heat generated by the light source 52 may in time gradually deteriorate the stability of the phosphor composition in the wavelength converting layer 51, it is advantageous to separate the edges 57 of the wavelength converting layer 51 from the light source 52 and the heat sink 53. Between the edges 57 of the wavelength converting layer 51 and the base plate at which the light source 52 is arranged, reflectors 56, e.g. diffuse or specular, or translucent diffusers (not shown) may be arranged for supporting the wavelength converting layer 51 for increasing the light output from the lighting device 5.

In the following, further embodiments of the invention, which may be combined with any one of the previously described embodiments, will be described.

Preferably, the ratio between the pitch p and the maximum distance from the light source to the wavelength converting layer $R_{max}$ is $R_{max}/p\geq 1$ for providing a more uniform color distribution or conversion along the linear lighting device. Further, the light sources may preferably be equally spaced in the row configuration.

The wavelength converting layer may comprise diffusing means, such as scattering particles, e.g. $TiO_2$ or $Al_2O_3$, air voids and/or a scattering surface structure. The diffusing means may be arranged within the wavelength converting layer or as a separate layer coated on the wavelength converting layer. Diffusing means may alternatively, or as a complement be arranged at the envelope for further smoothening any color irregularities or artifacts present at the wavelength converting layer and thereby in the light intensity distribution. Further, the wavelength converting layer and/or the envelope may comprise optical structures, such as prisms, lenticulars or holographically made structures, for improving the color uniformity and/or spread the light in desired directions to tune the far field intensity distribution of the lighting device. For reducing the quality of the optical contact between the wavelength converting layer and the envelope, the outer surface of the wavelength converting layer and/or the inner surface of the envelope 25 may be rough, at least in the region where the two optical parts about each other. Alternatively, an air gap may be defined between the wavelength converting layer and the envelope for avoiding optical contact. Furthermore, the wavelength converting layer and/or the envelope may be extruded optical covers, i.e. manufactured by extruding soft material through an opening having the desired profile, with a uniform thickness or a variation in thickness dependent on the angle $\phi$.

The person skilled in the art realizes that the present invention by no means is limited to the preferred embodiments described above. On the contrary, many modifications and variations are possible within the scope of the appended claims. For example, the examples of curve shape and size of the wavelength converting layer, as well as other constituent parts of the lighting device described with reference to FIG. 2 is also applicable in any of the other described embodiments.

The invention claimed is:

1. A lighting device comprising:

a wavelength converting layer having a curved shape, and a light source arranged to emit light towards the wavelength converting layer, wherein the wavelength converting layer intersects a plane extending through the light source and being parallel with the optical axis of the light source, at a curve given, in a polar coordinate system centered at the light source, by the equation:

$$R(\phi)=k\cdot\cos(\phi)^{1/2}\pm D,$$

wherein k is a constant, $\phi$ is an angle with respect to said optical axis, $I(\phi)$ defines a luminous intensity profile of the light source and D is a deviation ranging from zero to 20% of the maximum value of said curve, $R_{max}$.

2. The lighting device as defined in claim 1, wherein the wavelength converting layer intersects said curve at least from $\phi=-30°$ to $\phi=30°$, preferably at least from $\phi=-60°$ to $\phi=60°$, and even more preferably at least from $\phi=-75°$ to $\phi=75°$.

3. The lighting device as defined in claim 1, wherein the wavelength converting layer intersects said curve at most from $\phi=-80°$ to $\phi=80°$.

4. The lighting device as defined in claim 3, wherein the constant (k) has a value comprised within the interval 0.005 to 0.02 meter.

5. The lighting device as defined in claim 4, wherein the light source is configured to emit light with a Lambertian-like distribution.

6. The lighting device as defined in claim 5, wherein the wavelength converting layer comprises a diffusing means.

7. The lighting device as defined in claim 5, further comprising an envelope enclosing the light source and the wavelength converting layer.

8. The lighting device as defined in claim 7, wherein a gap is defined between the wavelength converting layer and the envelope.

9. The lighting device as defined in claim 7, wherein the surface of the wavelength converting layer facing the envelope has an uneven surface structure.

10. The lighting device as defined in claim 9, wherein the lighting device is a linear-type lighting device.

11. The lighting device as defined in claim 10, wherein the wavelength converting layer is elongated and said plane is perpendicular to the longitudinal direction of the wavelength converting layer.

* * * * *